US007255918B2

(12) United States Patent
Watanabe et al.

(10) Patent No.: US 7,255,918 B2
(45) Date of Patent: Aug. 14, 2007

(54) COATED PAPER SHEET

(75) Inventors: Harumi Watanabe, Tokyo (JP); Atsushi Myojo, Tokyo (JP); Hiroyuki Wakasa, Tokyo (JP); Osamu Kitao, Yokohama (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 10/454,610

(22) Filed: Jun. 5, 2003

(65) Prior Publication Data

US 2004/0001963 A1 Jan. 1, 2004

(30) Foreign Application Priority Data

Jun. 10, 2002 (JP) ..... 2002-168793

(51) Int. Cl.

| | |
|---|---|
| ***B32B 23/08*** | (2006.01) |
| *G03G 5/10* | (2006.01) |
| *D21H 17/42* | (2006.01) |
| *D21H 19/44* | (2006.01) |

(52) U.S. Cl. ..... 428/342; 428/340; 428/341; 428/511; 428/512; 428/514

(58) Field of Classification Search ..... 428/340, 428/341, 342, 511, 512, 514
See application file for complete search history.

(56) References Cited

U.S. PATENT DOCUMENTS

| | | | | |
|---|---|---|---|---|
| 4,030,970 | A * | 6/1977 | Tominaga et al. | 162/168.1 |
| 4,170,672 | A | 10/1979 | Moriya et al. | |
| 4,439,496 | A * | 3/1984 | Tamagawa et al. | 428/513 |
| 5,750,253 | A | 5/1998 | Satake et al. | |
| 6,034,181 | A * | 3/2000 | Bazaj et al. | 525/218 |
| 6,180,304 | B1 * | 1/2001 | Bourdelais et al. | 430/64 |
| 6,190,633 | B1 * | 2/2001 | Takahashi et al. | 423/432 |

FOREIGN PATENT DOCUMENTS

| | | |
|---|---|---|
| EP | 0 290 115 | 11/1988 |
| EP | 0 770 493 | 5/1997 |
| EP | 0 860 547 | 8/1998 |
| EP | 0 904 951 | 3/1999 |
| JP | 3-227491 | 10/1991 |
| JP | 5-341553 | 12/1993 |
| JP | 06-003765 | 1/1994 |
| JP | 07-070978 | 3/1995 |
| JP | 11-160906 | 6/1999 |
| JP | 11-174713 | 7/1999 |
| JP | 2000-282395 | 10/2000 |

OTHER PUBLICATIONS

DATABASE WPI, Derwent Publications Ltd., London, GB; AN 1995-145443 XP-002257325.
DATABASE WPI, Derwent Publications Ltd., London, GB; AN 2001-453436 XP-002257245.
DATABASE WPI, Derwent Publications Ltd., London, GB; AN 1994-51290 XP-002257324.
Communication from the European Patent Office in Application EP 03 25 3627 dated Oct. 29, 2003.

* cited by examiner

*Primary Examiner*—D. S. Nakarani
(74) *Attorney, Agent, or Firm*—Westerman, Hattori, Daniels & Adrian, LLP

(57) ABSTRACT

A coated paper sheet provided with a coating layer formed on a paper sheet substrate and containing a pigment and a binder and optionally a pre-coated polyacrylamide-containing anionic acrylic resin layer formed between the substrate and coating layer, and having a 75° specular gloss of 70% or more, an air permeability of 4000 seconds or less, a Clark stiffness, in terms of critical strength L, of 12 cm or more in a cross direction and an internal bond strength of 200 mJ or more, exhibits high resistance to blistering, excellent printer-passing property, and high quality image-recording property and useful for both of offset printing and electrophotographic duplicating or printing.

3 Claims, No Drawings

COATED PAPER SHEET

BACKGROUND OF THE INVENTION (1) Field of the Invention

The present invention relates to a coated paper sheet. More preferably, the present invention relates to a coated paper sheet having a high gloss, a high Clark stiffness determined in a cross direction (CD) of the sheet and being free from generation of blistering on the sheet when subjected to offset printing or full color printing by, for example, an electrophotographic printing system, and thus exhibiting an excellent passing property through the printing system and a superior capability of being printed with printed images having high quality, namely high clarity and sharpness.

(2) Description of the Related Art

Currently, due to a strong demand of full color printing, high speed printing and high image quality printing, a large amount of coated paper sheets are consumed in the printing and publishing business. Particularly, in the field of on-demand-printing, there is a significant trend of preparing various publications, which have been prepared by the conventional printing method, by a color copying machine or a color printer which can relatively easily respond to a small order. Also, application of coated paper sheets having a high white gloss, in place of conventional paper sheets for plain paper copiers (PPC) and for printers, to electrophotographic copiers and printers, are now increasing.

To respond to the above-mentioned trend, the coated paper sheets for the on-demand publishing must provide sufficient aptitude both for off-set press and for electrophotographic copying machine and printers. For the off-set press, the recording sheets must have a high surface strength (toughness) and a high blister resistance. Also, for electrophotographic full color copying machine and printers, the recording sheet must have a high stiffness and a high blister resistance. Further, to prepare high grade printing, the recording paper sheet is required to have an improved stiffness, because conventional coated paper sheets having a high white gloss are unsatisfactory for high grade printing.

Generally, the coated paper sheet having a high white gloss are produced by coating a substrate paper sheet with a coating containing a white pigment having an average particle size of 2 μm or less, in a dry solid amount of 10 g/m$^2$ or more per surface of the sheet, and smoothing the coating layer surface by calendering. In this case, it is known that the coated paper sheets having a high white gloss is compressed by the calendering and thus the stiffness of the coated paper sheets decreases.

Further, in view of various social requirements due to developments in movements for conservation of natural resources and protection of natural environment and other requirements to decrease a load of consumers on transportation of the prints, and to scale-down of the space for storing the prints in home and library, it is expected that the mass of the recording paper sheets will be further decreased. However, generally speaking, the decrease in mass of the paper sheets causes the thickness and stiffness of the paper sheets to be decreased and thus a problem, that the printed products appear to be a low grade and a difficulty in turning over the leaves of printed products and in reading the printed products increases, occurs.

In the offset sheet press or the electrophotographic copying machine or printer, the stiffness of the paper sheets greatly influences on the passing property of the paper sheets through the printer, and thus it is severly controlled as an important quality item. Especially, in the electrophotographic copying machine and printer, when a paper sheets having a low stiffness are employed, the paper sheets may sometimes be fed irregularly into the printer, are not smoothly passed through the printer and may block the delivery from the printer.

As one way of enhancing the stiffness of the coated paper sheet, the substrate paper sheet is produced from a mechanical pulp which contributes to enhancing the stiffness of the substrate paper sheet and thus of the resultant coated paper sheet. However, the use of the mechanical pulp causes the resultant coated paper sheet to exhibit a low smoothness and a reduced whiteness and it appears to be a low grade. Also, when a chemical pulp produced mainly from soft woods, for example, NBKP is used in a major proportion to produce the paper sheet substrate, the resultant paper sheet exhibits a high stiffness. However, the air permeance of the resultant paper sheet is undesirably increased.

It has been attempted to increase the stiffness of the paper sheet by make the paper sheet bulky. The bulkiness of the paper sheet can be increased by increasing the freeness of the pulp, by reducing the pressure of a wet press or by reducing the pressure of calendering. However, while the increase in bulkiness contributes to enhancing the stiffness of the resultant paper sheet, the resultant paper sheet has a porous inside structure and a low smoothness. When the porous paper sheet is coated with a pigment-containing coating liquid, a great portion of the coating liquid permeates inside the porous paper sheet, and thus the coverage of the coating liquid over the surface of the porous paper sheet decreases. Therefore, after drying, the resultant coated paper sheet is unsatisfactory due to a low gloss and a low uniformity of the gloss. The coated paper sheet having an insufficient gloss must be smoothed by calendering under increased pressure. Thus, the resultant calendered paper sheet exhibits an increased compressive modulus and a greatly decreased stiffness.

Generally, it is known that when an attempt is made to improve the quality of printed images by enhancing the gloss of the paper sheet, the resultant paper sheet has a low stiffness and thus exhibits a poor passing property through the printer. To solve this problem, Japanese Unexamined Patent Publication No. 5-341,553 discloses an attempt to solve the problem of the poor passing property of the paper sheet by controlling a basis mass of the paper mass in the range of from 75 to 95 g/m$^2$.

Further, in the production of a coated paper sheet having a high white gloss, an application of a calendering treatment causes the paper sheet substrate and the coating layer of the calendered coated paper sheet to respectively exhibit increased densities and the resultant coated paper sheet to exhibit a significantly decreased air permeance. In the case where the coated paper sheet having the low air permeance is subjected to a printing procedure using an offset press or an electrophotographic copying machine or printer, a problem such that when the printed ink images are dried or the toner images are heat-fixed, blisters are generated in the coated paper sheet, occurs. The bisters generated in the coated paper sheet are classified into macro-blisters and micro blisters. The macro-blisters are generated by deforming the substrate and the coating layer due to expansion of water contained in the substrate. The macro-blisters are formed in the image-printed portions of the coated paper sheet. The micro-blisters are fine bisters generated in the image-printed portions of the coated paper sheet due to expansion of water vapor generated between the coating layer and the ink or toner images printed on the coating layer. The micro-blisters cause a decrease in gloss of the printed coated paper sheet.

As a general countermeasure to macro-bister generation, there is a method of preventing the breakage of the paper sheet substrate by enhancing the internal bond strength of the substrate. As a method of enhancing the internal bond strength of the substrate, an employment of pulp fibers prepared under an intensified beating condition and having a high bonding strength to each other to form the paper sheet substrate, a coating or impregnating of the paper sheet substrate with a resin and a mixing of a paper strength-enhancing agent into the paper sheet for the substrate, are effectively utilized. However, the use of the pulp fibers produced under a intensified beating condition and the impregnation or coating with a resin contribute to enhancing the internal bond strength of the paper sheet substrate, but cause the air permeance of the paper sheet substrate to decrease. Therefore, these measures can control only the generation of macro-blisters but not of micro-blisters. As a measure of mixing the paper strength-enhancing agent into the paper-forming pulp slurry, Japanese Unexamined Patent Publication No. 3-227,491 discloses mixing a polyacrylamide-compound-containing paper strength-enhancing agent into a paper-forming pulp slurry. In this case, however, when the paper strength-enhancing agent is mixed in too large an amount, flocks are generated in the pulp slurry. Therefore, in order to maintain the process conditions and the uniformity of the resultant paper sheet at high level, the paper strength-enhancing agent must be employed in a limited amount.

Thus, it is difficult to obtain a satisfactory effect on the prevention of the generation of blisters by the use of a paper strength-enhancing agent.

To prevent the generation of the micro-blisters, an increase in the air permeance of the coating layer is considered effective. However, in the coating layer, the higher the air permeance, the lower the white gloss. Accordingly, the conventional coated paper sheet having a high white gloss exhibits an insufficient resistance to micro-blister generation.

As Japanese Unexamined Patent Publication No. 11-174,713 discloses, it is known that, when coated paper sheets having a high white gloss are printed by an offset sheet press or electrophotographic copying machine or printer, particularly in high humid circumstances and, for example, in a rainy season, a closed package of the coated paper sheets is opened and the coated paper sheets are subjected to printing, immediately after the start of printing, misfeeding of a plurality of superposed paper sheets, or blocking of the paper sheet delivery, often occur. The reason of the above-mentioned problem is assumed to be that the coated paper sheets with a high white gloss have a high smoothness and thus are easily adhered to one another, and the surface tension and hydrogen bond of water absorbed in the coating layers of the coated paper sheets cause the coated paper sheets to be adhered one another, and the increased static friction coefficient between the coated paper sheets adjacent to each other, which friction prevents the smooth passing of the coated paper sheets through the printer, increases.

As stated above, when subjected to an offset printing procedure or an electrophotographic full color copying machine, the coated paper sheet having a high 75 degrees specular gloss of 70% or more and a basis mass of, for example, 70 to 90 g/m$^2$ and further exhibiting both a high resistance to blistering and an excellent passing property through the printer or copying machine during the printing procedure have not yet been provided, in practice.

SUMMARY OF THE INVENTION

An object of the present invention is to solve the above-mentioned problems of the prior art and to provide a coated paper sheet, when employed in an offset press or an electrophotographic full color copying machine, exhibiting a high resistance to blistering, a high stiffness in a cross direction of the sheet and an excellent passing property through the printer or copying machine during the printing procedure, having a 75 degrees specular white gloss of 70% or more, and being appropriate to printing high-quality images thereon.

The inventors of the present invention extensively researched means for attaining the above-mentioned object. As a result, it was found that, when a coated paper sheet having, as a whole, a specific low air permeance, a limited high stiffness in the cross direction and an appropriate internal bond strength at a certain value or more, is subjected, even where it has a high gloss of 70% or more, to an offset printing procedure or an electrophotographic full color copying or printing procedure, the resistance to blistering and the printer-passing property of the coated paper sheet is excellent.

The present invention was completed on the basis of the above-mentioned finding.

Namely, the above-mentioned object can be attained by the coated paper sheet of the present invention which comprises a paper sheet substrate and a coating layer formed on at least one surface of the sheet substrate comprising, as principal components, a pigment and a binder, and having a 75 degree specular gloss of 70% or more, determined in accordance with TAPPI T480 om-92, which coated paper sheet exhibits, as a whole, (1) an air permeability of 4000 seconds or less, determined in accordance with JIS P 8117 using Type B testing device, (2) a Clark stiffness, in terms of a critical length L, of 12 cm or more, determined in a cross direction of the coated paper sheet in accordance with JIS P 8143 using a Clark stiffness tester and a specimen having a width of 30 mm, and (3) an internal bond strength of 200 mJ or more, determined in accordance with TAPPI UM 403.

In the coated paper sheet of the present invention, the paper sheet substrate is preferably one pre-coated with a polyacrylamide-containing anionic acrylic resin in an amount of 0.5 to 3 g/m$^2$.

In the coated paper sheet of the present invention, the polyacrylamide-containing anionic acrylic resin is preferably selected from copolymers of 50% by mass or more of acrylamide with 1 to 40% by mass of acrylonitrile and 1 to 20% by mass of at least one member selected from acrylic acid and methacrylic acid.

In the coated paper sheet of the present invention, the paper sheet substrate preferably exhibits, when immersed in water having a temperature of 20° C. for 5 seconds, a increase in thickness of 40% or less, calculated in accordance with the following equation:

$$A(\%)=\{(T_1-T_0)/T_0\}\times 100$$

wherein A represents a increase in thickness of the paper sheet substrate, $T_0$ represents a thickness of the paper sheet substrate before the immersion in water, and $T_1$ represents a thickness of the paper sheet substrate after the immersion in water.

In the coated paper sheet of the present invention, the paper sheet substrate preferably has a basis mass of 50 to 110 g/m$^2$.

In the coated paper sheet of the present invention, the paper sheet substrate preferably has an apparent density in the range of 0.7 to 0.9, and satisfies the relationships (1) and (2):

$$Y1 \leqq 61X-34 \quad (1)$$

$$Y2 \geqq 107X+123 \quad (2)$$

wherein x represents an apparent density of the paper sheet substrate, Y1 represents an air permeability of the paper sheet substrate determined in accordance with JIS P 8117 using Type B testing device, and Y2 represents a Clark stiffness of the paper sheet substrate determined in accordance with JIS P 8143, in the cross direction of the coated paper sheet.

DESCRIPTION OF THE PREFERRED EMBODIMENTS

The inventors of the present invention extensively researched means for imparting a high stiffness and a low air permeance to a coated paper sheet having a high gloss. As a result, it was found and confirmed that when a coated paper sheet having, as a whole, a specific low air permeance, a limited high stiffness and an appropriate internal bond strength at a certain value or more, is subjected, even where it has a white gloss of 70% or more, to an offset press or an indirect drying electrophotographic full color copying machine or printer, excellent resistance to blistering and a good passing property through the printer or copying machine can be exhibited, and the printed images have a high quality.

In the coated paper sheet of the present invention having a high 75 degrees specular gloss of 70% or more, the coated paper sheet has, as a whole, an air permeability of 4,000 seconds or less, preferably 3,000 seconds or less, more preferably 2,000 seconds or less. If the air permeability is more than 4,000 seconds, when the printed ink images are dried or the printed toner images are heat-fixed, and water contained in the substrate is evaporated and rapidly expanded, the expanding water vapor locally pushes outward the coating layer having a low air permeance to generate micro-blisters in the image-printed portions of the coating layer, and the gloss of the coating layer surface decreases.

Also, in the coated paper sheet of the present invention having a high white gloss of 70% or more, the coated paper sheet has, as a whole, an internal bond strength of 200 mJ or more, preferably 230 mJ or more, still preferably 250 mJ or more, further preferably 270 to 350 mJ. If the internal bond strength is less than 200 mJ, the generation of the macro-blisters cannot be completely prevented even where the air permeability of the coated paper sheet is in the range of 4,000 seconds or less.

In the coated paper sheet of the present invention having a high white gloss of 70% or more, the coated paper sheet has a Clark stiffness represented in terms of a critical length L, of 12 cm or more, preferably 13 cm or more, still more preferably 14 cm or more, in a cross direction of the sheet. If the critical length L in the cross direction is less than 12 cm, the resultant coated paper sheet exhibits an insufficient passing property through the printer or copying machine. Particularly, when employed in an indirect drying electrophotographic full color copying machine or printer, especially in high humid circumstances, the resultant coated paper sheet exhibits a poor passing property through the printer or copying machine, and the delivery of the printed sheet is often blocked.

In the coated paper sheet of the present invention, preferably, the paper sheet substrate is one pre-coated with a polyacrylamide-containing anionic acrylic resin, while controlling the amount of the coated resin to 0.5 to 3 g/m$^2$, and the resultant coated paper sheet has a high stiffness and a low air permeance and further has an internal bond strength of a certain value or more. As compared with this, when a coating material comprising starch and/or polyvinyl alcohol is employed in place of the anionic acrylic resin, the resultant paper sheet substrate exhibits too high a value in units of seconds of air permeance, while the imparted internal bond strength and stiffness are satisfactory and, thus, when a coated paper sheet is prepared from the pre-coated paper sheet substrate, and printed, undesired blisters are generated in the toner or ink printed portions of the printed coated paper sheet.

The pre-coating procedure can be carried out by using a conventional size press coater, a gate roll size press coater, or a film transfer size press coater or a rod coater, a Bill-blade coater, a short dwell-blade coater or a spray coater.

As a reason for the fact that the air permeability in the units of seconds of the paper sheet substrate pre-coated with the polyacrylamide-containing anionic acrylic resin can be kept low, it is assumed that the film-forming property of the polyacrylamide-containing anionic acrylic resin is lower than that of starch or polyvinyl alcohol. Also, the polyacrylamide-containing anionic acrylic resin has a rigidity-enhancing effect derived from the anionic acrylic resin structure and an internal bond strength-enhancing effect derived from the polyacrylamide structure. Therefore, the polyacrylamide-containing anionic acrylic resin can impart an appropriate stiffness and an internal bond strength to the coated paper sheet of the present invention.

The polyacrylamide-containing anionic acrylic resin usable for the present invention is preferably selected from copolymers of 50% by mass or more of acrylamide with 1 to 40% by mass of acrylonitrile and 1 to 20% by mass of at least one member selected from acrylic acid and methacrylic acid.

The polyacrylamide-containing anionic acrylic resin can be produced by conventional addition polymerization process and apparatus. For example, a reaction vessel is charged with acrylamide, acrylonitrile and at least one member selected from acrylic acid and methacrylic acid each in an amount in the above-mentioned range, and water; the total concentration of the above-mentioned monomer an the temperature of the mixture are adjusted to 20% and 30° C., respectively; the mixture is further mixed with a polymerization-initiator consisting of 0.3% by mass of ammonium persulfate and 0.2% by mass of sodium hydrogen sulfite, while agitating the reaction mixture; the temperature of the reaction mixture is increased to 80° C. and maintained at 80° C. for 4 hours; after the polymerization is completed, the resultant reaction mixture is neutralized with sodium hydroxide. As a result, an aqueous polyacrylamide-containing anionic acrylic resin solution having a pH of 7, a polymer concentration of 20% by mass and a viscosity of 2000 mPa·s, is obtained.

The polyacrylamide-containing anionic acrylic resin is preferably pre-coated in an amount of 0.5 to 3 g/m$^2$ more preferably 0.7 to 2.5 g/m$^2$ per surface of the paper sheet substrate. If the pre-coating amount is less than 0.5 g/m$^2$, the resultant pre-coated paper sheet may have insufficient stiffness and internal bond strength, and thus may exhibit an unsatisfactory passing property through the printer and an insufficient resistance to blistering. Also, if the pre-coating amount is more than 3.0 g/m$^2$, the effect on enhancements of the stiffness and the internal bond strength due to the portion of the resin in amount over 3 g/m$^2$ is poor, and the increase in cost may cause an economical disadvantage.

The pre-coating procedure with the polyacrylamide-containing anionic acrylic resin is carried out by using a conventional size press coater, a gate roll size press coater, a film transfer size press coater, a rod coater, a Bill-blade coater, a short dwell-blade coater or a spray coater.

In the case where a bulky paper sheet is used as a paper sheet substrate for the coated paper sheet of the present invention having a high white gloss, the resultant coated paper sheet exhibits a low modulus of elasticity and a low surface smoothness, while the air permeance is improved, and when a calendering treatment is applied to the resultant coated paper sheet, the stiffness of the sheet is greatly reduced.

The inventors of the present invention studied how to solve this problem. As a result, it was found that in the case where a coated paper sheet having a white gloss of 70% or more is used in an offset press or a indirect drying electrophotographic full color copying machine or printer, a decrease in passing property of the coated paper sheet through the printer or copying machine due to unappropriate air permeance and Clark critical length in the cross direction of the sheet, can be prevented by controlling the air permeance and the Clark stiffness in the cross direction of a coated paper sheet having an apparent density in the range of 0.7 to 0.9 so as to satisfy the relationships (1) and (2):

$$Y1 \leqq 61X-34 \quad (1)$$

$$Y2 \geqq 107X+123 \quad (2)$$

wherein X represents an apparent density of the paper sheet substrate, Y1 represents an air permeability of the paper sheet substrate determined in accordance with JIS P 8117 using Type B testing device, and Y2 represents a Clark stiffness of the paper sheet substrate determined in accordance with JIS P 8143, in the cross direction of the coated paper sheet.

If Y1 is more than 61X−34, the resultant coated paper sheet may not be able to completely prevent the generation of macro-blisters and micro-blisters. Also, if Y2 is less than −107X+123, the passing property of the resultant coated paper sheet through the printer or copying machine may become unsatisfactory.

The coated paper sheet substrate usable for of the present invention preferably has a basis mass of 50 to 110 g/m$^2$, more preferably 55 to 100 g/m$^2$.

In the coated paper sheets of the present invention having a high white gloss of 70% or more, due to a high smoothness of the sheet surfaces, the coated paper sheet surfaces adjacent to each other are closely contacted to each other and thus a high friction coefficient is generated between the coated paper sheet surfaces adjacent to each other. Japanese Unexamined Patent Publication No. 11-160906 teaches that when a paper sheet substrate for a coated paper sheet should have a property such that when it is immersed in water at a temperature of 20° C. and immediately taken up, an increase in thickness of the paper sheet substrate from the dry thickness thereof is 30 μm or less.

In the paper sheet substrate for the coated paper sheet of the present invention, when the substrate has a basis weight is in the range of from 50 to 110 g/m$^2$, an application of the above-mentioned teaching of the Japanese publication, to the substrate for the present application, is not appropriate.

Also, the inventors of the present invention researched why the teach of the Japanese publication is not appropriate for the coated paper sheet of the present invention, in consideration of the fact that even when the increases in the paper thickness of a plurality of paper sheets are the same as each other, if basis masses of the sheets are different from each other, the close contacting properties, namely the friction coefficients of the sheets are different from each other. As a result, it was found that the change in paper thickness between before and after immersion in water is caused by the close contacting property of the paper sheets. Namely, in the coated paper sheet of the present invention having a high white gloss of 70% or more, an increase in paper thickness when the coated paper sheet is immersed in water at a temperature of 20° C. for 5 seconds and then taken up, is preferably 40% or less, more preferably 30% or less.

The increase in paper sheet thickness is calculated in accordance with the following equation:

$$A(\%)=\{(T_1-T_0)/T_0\}\times 100$$

wherein A represents a increase in thickness of the paper sheet substrate, $T_0$ represents a thickness of the paper sheet substrate before the immersion in water, and $T_1$ represents a thickness of the paper sheet substrate after the immersion in water.

If the paper thickness change is more than 40%, the resultant coated paper sheets superposed on each other and stored or used in an ambient high humidity atmosphere absorb the moisture and are swollen in the thickness direction. The swelling in the thickness direction causes the close contact of the superposed coated paper sheets with each other to be intensified, and the friction coefficient between the coated paper sheets adjacent to each other to increase. The changes in the above-mentioned properties may cause a plurality of the coated paper sheets superposed on each other to be fed together into a recording section of the printer or copying machine and a delivery section of the printer or copying machine to be blocked by the plurality of the coated paper sheets traveling together through the printer or copying machine.

The paper sheet substrate usable for the present invention is selected from acidic paper sheets and neutrallized paper sheets usable for conventional coated printing paper sheets. There is no limitation to the type and production method of the pulp usable for the paper sheet substrate. Usually, chemical pulps, for example, KP, SP, AP, etc.; mechanical pulps for example, SGP, SCP, RGP, CGP, TMP, BCTMP, CTMP, etc.; recycled fibers, for example, DIP, etc.; and non-wood pulps for example, kenaf, bamboo, rice straw, paper mulberry (kozo), mitsumata and flax pulps, are usable for the present invention. The above-mentioned pulps may be mixed in an appropriate amount as long as the desired effect of the present invention is not impaired. Also, the chlorine-free pulps, for example ECF pulp and TCF pulp are also preferably employed. The paper machine for producing the paper sheet substrate may be selected from conventional paper machines, for example, Fourdrinier paper machine, tanmo machine, Yankee paper machine, Twine-wire paper machine, and inclined type wire former.

The paper sheet substrate usable for the present invention optionally contains a filler. The filler may comprises at least one member selected from various types of pigments commonly used in woodfree paper sheets. The pigments usable as the filler include mineral pigments, for example, kaolin, calcined kaolin, calcium carbonate, calcium sulfate, barium sulfate, titanium dioxide, talc, zinc oxide, alumina, magnesium carbonate, magnesium oxide, silica, white carbon, bentonite, zeolite, sericite and smectites; and organic hollow, filled, perforated and hollow fine pigment particles of polystyrene resins, urea-formaldehyde resins, melamine-formaldehyde resins, acrylic polymer resins, and vinylidene chloride polymer resins.

In the production of the substrate paper sheet, the paper-forming material slurry optionally contains, in addition to the pulp fibers and the filler one or more additives for the paper-making process, for example, anionic, nonionic, cationic and ampholytic retention aids, filtration-enhancing agents, paper strength additives and internal sizing agents. The pulp slurry for the substrate paper sheet optionally further contains one or more additives for paper-forming process, selected from, for example, dyes, fluorescent whitening agents, pH-regulator, antifoaming agents, pitch-controlling agents, and slime-controlling agents.

The coating material for coating or impregnating the paper sheet substrate for the present invention comprises, as principal components, a pigment and a binder, and optionally a polyacrylamide-containing anionic acrylic resin. The coating material optionally further comprises, in addition to the binder, for example, starch, polyvinyl alcohol and polyacrylamide, a surface sizing agent selected from, for example, rosin-containing sizing agents, synthetic sizing agents, petroleum resin sizing agents and neutral sizing agents; electroconductive agents, for example, sodium chloride and sodium sulfate, in an amount in the range in which the desired effect of the present invention is not impaired. To enhance the storage stability of the coated paper sheet printed by an electrophotographic copying machine or printer, neutral sizing agents are preferably employed. The neutral sizing agents are preferably selected from alkenylsuccinic acid anhydride sizing agents, alkyleneketene dimers, alkenylketene dimers, neutral rosin, petroleum sizing agents, olefin resins and styrene-acrylic copolymer resins.

There is no limitation to the type of the pigment for the coating layer of the coated paper sheet of the present invention, preferably, the pigment comprises at least one member selected from mineral pigments, for example, ground calcium carbonate, precipitated calcium carbonate, kaolin, calcined kaolin, structural kaolin, delaminated kaolin, talc, calcium sulfate, barium sulfate, titanium dioxide, zinc oxide, alumina, magnesium carbonate, magnesium oxide, silica, magnesium aluminosilicate, particulate calcium silicate, particulate magnesium carbonate, particulate precipitated calcium carbonate, white carbon, bentonite, zeolite, sericite and smectites; and organic hollow, perforated and filled fine pigment particles of polystyrene resins, styrene-acryl copolymer resins, urea-formaldehyde resins, melamine-formaldehyde resins, acrylic polymer resins, vinylidene polymer resins and benzoguanamine resins. These pigments can be employed alone or in a mixture of two or more thereof.

The binder for the coating layer comprises at least one member selected from water-soluble and water-dispersible polymeric materials. The polymeric materials include natural and semisynthetic polymeric compounds, for example, starch compounds, for example, cationic starches, ampholic starches, oxidized starches, enzyme-modified starches, thermochemically modified starches, esterified starches and etherified starches, cellulose derivatives, for example, carboxymethyl cellulose and hydroxyethyl cellulose, gelatin, casein, soybean protein and natural rubber, and synthetic polymeric compounds, for example, polyvinyl alcohol, polydienes, for example, isoprene polymers, neoprene polymers, and polybutadiene, polyalkenes, for example, polybutene, polyisobutylene, polypropylene, and polyethylene, vinyl polymers and copolymers, for example, polymers and copolymers of vinyl halides, vinyl acetate, styrene, (meth) acrylic acid, (meth)acrylate esters, (meth)acrylamide, and methylvinylether, synthetic rubber latices, for example, latices of styrene-butadiene copolymers, and methyl methacrylate-butadiene copolymers, polyurethane resins, polyester resins, polyamide resins, olefin-maleic anhydride copolymer resins and melamine-formaldehyde resins. These polymeric compounds for the additional binder component may be employed alone or in a mixture of two or more thereof in response to the purpose of using the binder.

The coating layer optionally further contains, in addition to the pigment and the binder, an additive comprising at least one member selected from, for example, surfactants, pH-regulators, viscosity-modifiers, softening agents, gloss-enhancing agents, waxes, dispersing agents, fluidity-modifiers, stabilizers, anti-static agent, cross-linking agents, sizing agents, fluorescent whitening agents, coloring materials, ultraviolet ray-absorbers, anti-foaming agents, water-resistant additives, plasticizers, lubricants, preservatives and scenting agents.

In the coated paper sheet of the present invention, the coating layer is preferably present in an amount of 8 to 20 $g/m^2$, more preferably 10 to 18 $g/m^2$. If the amount of the coating layer is less than 8 $g/m^2$, the resultant coating layer may not sufficiently cover and smooth the surface of the paper sheet substrate, and thus may exhibit an unsatisfactory receiving property for the printing ink or toner. Also, the amount of the coating layer is more than 20 $g/m^2$, the drying property of the coating liquid layer may be insufficient to cause the coating efficiency to be low and the production cost of the coated paper sheet to be too high.

The coating procedure for the coating layer can be carried out by using any one of the conventional coating apparatuses, for example, blade coaters, air knife coaters, roll coaters, reverse roll coaters, bar coaters, curtain coaters, die slot coaters, gravure coaters, champlex coaters, brush coaters, two roll-type and metering blade type sizepress coaters, Bill-blade coaters, short dwell-blade coaters, lip coaters and gate roll coaters.

The coating layer may be formed on both the front and back surfaces of the substrate paper sheet and/or in a multi-layered structure. The multi-layered coating layer can be formed by forming one or more intermediate coating layers on a surface of the substrate paper sheet, and an outermost coating layer is formed on the intermediate coating layer or layers. When the coating layer is formed on the two surfaces of the substrate paper sheet or in the multi-layered structure, the compositions and amount of a plurality of the coating layers may be the same as each other or different from each other. The composition of each coating liquid may be designed in consideration of the purpose and the desired properties of the coating layer. When the coating layer is formed on only a front surface of the substrate paper sheet, the back surface of the substrate paper sheet may be coated with a synthetic resin layer, a pigment-binder mixture layer, or an anti-static layer. The above-mentioned back coating layer contributes to enhancing a resistance to curling, the printing capability and a resistance to blocking of feeding and/or delivering of the coated paper sheets into or from the printer. The back surface of the substrate paper sheet may be treated with an adhesive, a magnetic material, a flame retardant agent, a thermal resistant agent, a waterproofing agent, an oil-proofing agent or an anti-slipping agent to impart a desired function to the back surface of the coated paper sheet.

In the production procedure of the coated paper sheet of the present invention, the coating layer is formed on the substrate paper sheet and, thereafter, the surface of the coating layer is smoothed during a drying procedure and/or a surface-treatment procedure. Also, the water content of the coating paper sheet is preferably adjusted to 3 to 10% by mass, more preferably about 4 to 8% by mass, to finish the coated paper sheet.

In the smoothing procedure, a conventional smoothing apparatus, for example, a super calender, gloss calender, or a soft calender may be employed on machine or off machine. The type of the smoothing apparatus and the number of nipping operations and the smoothing temperature applied to the coated paper sheet can be controlled with reference to the practice of a usual smoothing procedure.

The coated paper sheet of the present invention having a high white gloss of 70% or more exhibits excellent for printing capability by offset press and indirect drying electrophotographic full color copying machine or printer and is particularly useful as a coated paper sheet for on-demand-printing purpose.

EXAMPLES

The present invention will be further illustrated by the following examples which are not intended to restrict the scope of the present invention in any way.

Example 1

An aqueous pulp slurry containing 100 parts by mass of a hardwood kraft pulp (LBKP) having a Canadian Standard freeness (CSF) of 450 ml was mixed with 5 parts by mass of precipitated calcium carbonate (trademark: PC, made by SHIRAISHI CALCIUM K.K.), and further mixed with starch in an amount of 1.0 part by mass, an alkenyl succinic acid anhydride in an amount of 0.1 part by mass and aluminum sulfate in an amount of 0.6 parts by mass each based of 100 parts by mass of the pulp. The resultant pulp slurry was subjected to a paper-making procedure using a Fourdrinier paper machine. The resultant wet paper sheet was coated with a sizepress liquid containing a polyacrylamide-containing anionic acrylic resin as a sizing agent and dried by using a sizepress machine to size the paper sheet with the sizing agent in a dry solid amount of 2.0 g/m$^2$. The resultant paper sheet for a substrate of a coated paper sheet had a basis mass of 60 g/m$^2$ and density of 0.70 g/cm$^3$.

A pigment slurry was prepared by dispersing 100 parts by mass of a kaolin pigment (trademark: ASTRAPLUS, made by IMERYS Co.) in water in the presence of 0.2 part by mass of a dispersing agent consisting of sodium polyacrylate (trademark: ARON A-9 made by TOA GOSEI K.K.) by using a Cowless disperser. The pigment slurry was mixed with 2.0 parts by mass of an oxidized starch (trademark PETROCOAT C-8, made by NICHIDEN KAGAKU K.K.) and 10 parts by mass of a styrene-butadiene copolymer latex (trademark: T-2550K, made by JSR K.K.), and further added with water, while stirring the slurry, to provide an aqueous coating liquid having a total dry solid content of 50% by weight.

The coating liquid was coated on the front and back surfaces of the paper sheet substrate by using a blade coater and dried to form front and back coating layers each in a dry solid amount of 10 g/m$^2$.

The resultant coated paper sheet was calendered on both the front and back surfaces thereof so that the 75 degrees specular gloss of the calendered front and back surfaces are adjusted each to 70%.

Example 2

A coated paper sheet was produced by the same procedures as in Example 1, except that the calendering procedure for both the front and back surface of the coated paper sheet was controlled so that the resultant calendered front and back surfaces of the coated paper sheet exhibit each a 75 degrees specular gloss of 76%.

Example 3

An aqueous pulp slurry containing 95 parts by mass of a hardwood kraft pulp (LBKP) having a Canadian Standard freeness (CSF) of 450 ml and 5 parts by mass of a softwood kraft pulp (NBKP) having a CSF of 450 ml was mixed with 5 parts by mass of precipitated calcium carbonate, and further mixed with starch in an amount of 1.0 part by mass, an alkenyl succinic acid anhydride in an amount of 0.1 part by mass and aluminum sulfate in an amount of 0.6 parts by mass each based of 100 parts by mass of the pulp. The resultant pulp slurry was subjected to a paper-making procedure using a Fourdrinier paper machine. The resultant wet paper sheet was coated with a sizepress liquid containing a polyacrylamide-containing anionic acrylic resin as a sizing agent and dried by using a sizepress machine to size the paper sheet with the sizing agent in a dry solid amount of 2.8 g/m$^2$. The resultant paper sheet for a substrate of a coated paper sheet had a basis mass of 60 g/m$^2$ and density of 0.70 g/cm$^3$.

Example 4

An aqueous pulp slurry containing 95 parts by mass of a hardwood kraft pulp (LBKP) having a Canadian Standard freeness (CSF) of 450 ml and 5 parts by mass of a softwood kraft pulp (NBKP) having a CSF of 450 ml was mixed with 5 parts by mass of precipitated calcium carbonate (trademark: PC, made by SHIRAISHI CALCIUM K.K.), and further mixed with starch in an amount of 1.0 part by mass, an alkenyl succinic acid anhydride in an amount of 0.1 part by mass, aluminum sulfate in an amount of 0.6 parts by mass and polyacrylamide as a paper strength additive in an amount of 0.1 part by mass each based of 100 parts by mass of the pulp. The resultant pulp slurry was subjected to a paper-making procedure using a Fourdrinier paper machine. The resultant wet paper sheet was coated with a sizepress liquid containing a polyacrylamide-containing anionic acrylic resin as a sizing agent and dried by using a sizepress machine to size the paper sheet with the sizing agent in a dry solid amount of 0.7 g/m$^2$. The resultant paper sheet for a substrate of a coated paper sheet had a basis mass of 50 g/m$^2$ and density of 0.70 g/cm$^3$.

The resultant paper sheet was coated as a substrate, with the same coating liquid and by the same procedures as in Example 1 and calendered in the same manner as in Example 1, to produce a coated paper sheet.

Comparative Example 1

An aqueous pulp slurry containing 100 parts by mass of a hardwood kraft pulp (LBKP) having a Canadian Standard freeness (CSF) of 450 ml was mixed with 5 parts by mass of precipitated calcium carbonate (trademark: PC, made by SHIRAISHI CALCIUM K.K.), and further mixed with starch in an amount of 1.0 part by mass, an alkenyl succinic acid anhydride in an amount of 0.1 part by mass and aluminum sulfate in an amount of 0.6 parts by mass each based of 100 parts by mass of the pulp. The resultant pulp slurry was subjected to a paper-making procedure using a Fourdrinier paper machine. The resultant wet paper sheet was coated with a sizing agent comprising starch and PVA in a mixing mass ratio of 70/30, dried by using a sizepress machine to size the paper sheet with the sizing agent in a dry solid amount of 2.5 g/m$^2$. The resultant paper sheet for a substrate of a coated paper sheet had a basis mass of 60 g/m$^2$ and density of 0.70 g/cm$^3$.

The resultant paper sheet was coated, as a substrate, with the same coating liquid by the same procedures as in Example 1 and calendered in the same manner as in Example 1, to produce a coated paper sheet.

Comparative Example 2

An aqueous pulp slurry containing 100 parts by mass of a hardwood kraft pulp (LBKP) having a Canadian Standard freeness (CSF) of 550 ml was mixed with 5 parts by mass of precipitated calcium carbonate (trademark: PC, made by SHIRAISHI CALCIUM K.K.), and further mixed with starch in an amount of 1.0 part by mass, an alkenyl succinic acid anhydride in an amount of 0.1 part by mass and aluminum sulfate in an amount of 0.6 parts by mass each based of 100 parts by mass of the pulp. The resultant pulp slurry was subjected to a paper-producing procedure using a Fourdrinier paper machine. The resultant wet paper sheet was coated with a sizing agent comprising starch and dried by using a sizepress machine to size the paper sheet with the sizing agent in a dry solid amount of 1.0 g/m$^2$. The resultant paper sheet for a substrate of a coated paper sheet had a basis mass of 60 g/m$^2$ and density of 0.60 g/cm$^3$.

The resultant paper sheet was coated as a substrate, with the same coating liquid by the same procedures as in Example 1 and calendered in the same manner as in Example 1, to produce a coated paper sheet.

Comparative Example 3

A coated paper sheet was produced by coating the same paper sheet for substrate as in Comparative Example 2 with the same coating liquid as in Example 1, and the resultant coated paper sheet was calendered to adjust the 75 degrees specular gloss thereof to 65%.

Comparative Example 4

An aqueous pulp slurry containing 95 parts by mass of a hardwood kraft pulp (LBKP) having a Canadian Standard freeness (CSF) of 450 ml and 5 parts by mass of a softwood kraft pulp (NBKP) having a CSF of 450 ml was mixed with 5 parts by mass of precipitated calcium carbonate (trademark: PC, made by SHIRAISHI CALCIUM K.K.), and further mixed with starch in an amount of 1.0 part by mass, an alkenyl succinic acid anhydride in an amount of 0.1 part by mass and aluminum sulfate in an amount of 0.6 parts by mass each based of 100 parts by mass of the pulp. The resultant pulp slurry was subjected to a paper-producing procedure using a Fourdrinier paper machine. The resultant wet paper sheet was coated with a sizing agent comprising a polyacrylamide-containing anionic acrylic resin and dried by using a sizepress machine to size the paper sheet with the sizing agent in a dry solid amount of 0.3 g/m$^2$. The resultant paper sheet for a substrate of a coated paper sheet had a basis mass of 60 g/m$^2$ and density of 0.70 g/cm$^3$.

The resultant paper sheet was coated as a substrate, with the same coating liquid by the same procedures as in Example 1 and calendered in the same manner as in Example 1, to produce a coated paper sheet.

Comparative Example 5

An aqueous pulp slurry containing 95 parts by mass of a hardwood kraft pulp (LBKP) having a Canadian Standard freeness (CSF) of 450 ml and 5 parts by mass of a softwood kraft pulp (NBKP) having a CSF of 450 ml was mixed with 5 parts by mass of precipitated calcium carbonate (trademark: PC, made by SHIRAISHI CALCIUM K.K.), and further mixed with starch in an amount of 1.0 part by mass, an alkenyl succinic acid anhydride in an amount of 0.1 part by mass and aluminum sulfate in an amount of 0.6 parts by mass each based of 100 parts by mass of the pulp. The resultant pulp slurry was subjected to a paper-making procedure using a Fourdrinier paper machine. The resultant wet paper sheet was coated with a sizing agent comprising a polyacrylamide-containing anionic acrylic resin and dried by using a sizepress machine to size the paper sheet with the sizing agent in a dry solid amount of 0.3 g/m$^2$. The resultant paper sheet for a substrate of a coated paper sheet had a basis mass of 45 g/m$^2$ and density of 0.70 g/cm$^3$.

The resultant paper sheet was coated, as a substrate, with the same coating liquid by the same procedures as in Example 1 and calendered in the same manner as in Example 1, to produce a coated paper sheet.

Each of samples of the coated paper sheets produced in the examples and comparative examples was subjected to the following tests.

(1) Gloss

The 75 degrees specular gloss of the sample was determined in accordance with TAPPI T480 om-92.

(2) Air Permeability

The air permeability of the sample was determined in accordance with JIS P 8117 using Type B testing device.

(3) Clark Stiffness

The Clark stiffness of the sample was measured in the cross direction of the sample in accordance with JIS P 8143 using a Clark stiffness tester and a specimen having a width of 30 mm, and represented in terms of a critical length L of the specimen.

(4) Internal Bond Strength

The internal bond strength of the sample was determined in accordance with TAPPI UM 403.

(5) Surface-Bonding Strength for Printing

The surface-bonding strength for printing of the sample was tested by using an offset ink T13 and evaluated in the following 4 classes.

| Class | Surface-bonding strength for printing which will be referred to as "printing strength" hereinafter |
|---|---|
| 4 | Printing strength is excellent<br>Sheet is usable in practice<br>Quality of printed images are excellent |
| 3 | Printing strength is high<br>Sheet is usable in practice |

-continued

| Class | Surface-bonding strength for printing which will be referred to as "printing strength" hereinafter |
|---|---|
| 2 | Printing strength is slightly low<br>Practical utility of sheet is slightly low |
| 1 | Printing strength is significantly low<br>Practical utility of sheet is low<br>Printed images have a poor quality |

(6) Resistance to Macro-Blister Generation

The macro-bisters generated in the printed sample were observed by the naked eye and evaluated in the following 3 classes.

| Class | Macro-blistering |
|---|---|
| 3 | No macro-blister are found<br>Practically usable<br>Printed images have excellent quality |
| 2 | Macro-blisters are found in portions of sheet<br>Practical utility of sheet is slightly low |
| 1 | Macro-blisters are found on whole sheet<br>Practical utility is poor<br>Quality of printed images are significantly poor |

(7) Resistance to Micro-Blister Generation

The generation of micro-blisters in the printed sample was observed by using a microscope at a magnification of 30 and evaluated in the following four classes.

| Class | Micro-blisters |
|---|---|
| 4 | No micro-blisters are found<br>Practically usable<br>Quality of printed images are excellent |
| 3 | Small micro-blisters are found<br>Practically usable |
| 2 | Certain micro-blisters are found<br>Practical utility is slightly low |
| 1 | Significant micro-blisters are found<br>Practical utility is low<br>Quality of printed images is poor |

(8) Appearance of Non-Printed White Sheet

The appearance of the sample (white, non-printed) was observed by the naked eye and evaluated in the following three classes.

| Class | Appearance |
|---|---|
| 3 | Good gloss and appearance |
| 2 | slightly unsatisfactory gloss and appearance |
| 1 | Poor gloss and appearance |

(9) Printer-Passing Property

Coated paper sheets in the number of 1000 sheets were continuously duplicated based on a color manuscript by using a color copying machine (model: IPSio Color 2100, made by RICOH K.K.), to test the passing property of the sheet through the copying In the duplicating procedure, occurrence of irregular feedings of plural paper sheets superposed on and adhered to each other and irregular windings of paper sheets around an image-fixing section of the copying machine were checked.

The results are evaluated in the following four classes.

| Class | Passing property |
|---|---|
| 4 | No irregular feeding and winding occurs |
| 3 | One to two irregular feedings and/or windings occur |
| 2 | Three to four irregular feedings and/or windings occur |
| 1 | Five or more irregular feedings and/or winding occur |

The results of measurements of basis mass, density, air permeance, stiffness and internal bond strength tests for the paper sheet substrates are shown in Table 1, and the results of measurements of air permeability, gloss, printing strength, bister resistances and passing property tests for the coated paper sheets are shown in Table 2.

TABLE 1

| | | Example No | | | | | | |
|---|---|---|---|---|---|---|---|---|
| | | Example | | | Comparative Example | | | |
| Item | | 1 and 2 | 3 | 4 | 1 | 2 and 3 | 4 | 5 |
| Basis mass | ($g/m^2$) | 60 | 60 | 50 | 60 | 60 | 60 | 45 |
| Density | ($g/cm^3$) | 0.70 | 0.70 | 0.70 | 0.70 | 0.60 | 0.70 | 0.70 |
| Air permeability | (sec.) | 6 | 6 | 6 | 14 | 8 | 6 | 6 |
| Critical length L | (cm) | 17.0 | 17.5 | 14.0 | 16.9 | 18.0 | 16.2 | 11.2 |
| Increase in thickness | (%) | 24 | 22 | 20 | 23 | 32 | 26 | 31 |

[Note]

*1—Clarke stiffness

TABLE 2

| Item | | Example No | | | | | | | | | Reference paper sheet for printing in trade |
|---|---|---|---|---|---|---|---|---|---|---|---|
| | | Example | | | | Comparative Example | | | | | |
| | | 1 | 2 | 3 | 4 | 1 | 2 | 3 | 4 | 5 | |
| Gloss | (%) | 70 | 76 | 70 | 70 | 70 | 70 | 65 | 70 | 70 | 72 |
| Air permeability | (sec) | 2700 | 3100 | 2500 | 2600 | 6500 | 3900 | 3400 | 2500 | 2300 | 57000 |
| Critical length L | (cm) | 17.1 | 16.5 | 17.4 | 14.0 | 16.8 | 11.8 | 12.3 | 16.0 | 11.1 | 14.3 |
| Internal bond strength | (mJ) | 230 | 235 | 260 | 250 | 300 | 170 | 170 | 190 | 180 | 180 |
| Printing strength | | 4 | 4 | 4 | 4 | 4 | 4 | 4 | 4 | 4 | 4 |
| Macro-blister | | 3 | 3 | 3 | 3 | 3 | 1 | 1 | 2 | 2 | 1 |
| Micro-blister | | 4 | 4 | 4 | 3 | 1 | 3 | 3 | 4 | 3 | 1 |
| Printer-passing property | | 4 | 4 | 4 | 3 | 4 | 2 | 3 | 3 | 1 | 3 |
| Appearance of non-printed white sheet | | 3 | 3 | 3 | 3 | 3 | 3 | 2 | 3 | 3 | 3 |

As Tables 1 and 2 clearly show, the coated paper sheets produced in Examples 1, 2, 3 and 4 and having a white gloss of 70% or more, a Clark critical length L of more than 12 cm, an air permeability of 4000 seconds or less and an internal bond strength of 200 mJ or more exhibited good printing strength, blister resistance and printer-passing property.

The coated paper sheet of the present invention has a high white gloss and exhibits, when used as recording sheet in an offset press or electrophotographic copying machine or printer, a high bister resistance and a good printer-passing property. Also, the printed images are satisfactory in clarity and sharpness. Thus, the coated paper sheet of the present invention is useful as a practical printing or duplicating sheet.

The invention claimed is:

1. A coated paper sheets usable for on-demand-printing purposes using an offset press or an indirect drying electrophotographic printer, comprising:

a paper sheet substrate and a coating layer formed on at least one surface of the sheet substrate by coating an aqueous dispersion liquid comprising, as principal components, a pigment and a binder, drying the coated liquid layer and smoothing the dried coating layer, and having a 75 degrees specular gloss of 70% or more, determined in accordance with TAPPI T480 om-92, wherein the paper sheet substrate is one surface-sizepressed, during a paper-forming procedure for the paper sheet substrate, with an aqueous sizepress liquid containg an anionic acrylic resin which comprises a copolymer of 50% by mass or more of acrylamide with 1 to 40% by mass of acrylonitrile and 1 to 20% by mass of at least one member selected from acrylic acid and methacrylic acid, in a dry solid amount of 0.5 to 3 g/m$^2$ and has a basis mass of 50 to 110 g/m$^2$, wherein the coated paper sheet has an air permeance, and wherein the coated paper sheet exhibits, as a whole, (1) an air permeability of 4000 seconds or less, determined in accordance with JIS P 8117 using Type B testing device, (2) a Clark stiffness, in terms of a critical length L, of 12 cm or more, determined in a cross direction of the coated paper sheet in accordance with JIS P 8143 using a Clark stiffness tester and a specimen having a width of 30 mm, and (3) an internal bond strength of 200 mJ or more, determined in accordance with TAPPIUM 403.

2. The coated paper sheet as claimed in claim 1, wherein the paper sheet substrate exhibits, when immersed in water having a temperature of 20° C. for 5 seconds, a increase in thickness of 40% or less, calculated in accordance with the following equation:

$$A(\%)=\{(T_1-T_0)/T_0\}\times 100$$

wherein A represents a increase in thickness of the paper sheet substrate, $T_0$ represents a thickness of the paper sheet substrate before the immersion in water, and $T_1$ represents a thickness of the paper sheet substrate after the immersion in water.

3. The coated paper sheet as claimed in claim 1, in which the paper sheet substrate has an apparent density in the range of 0.7 to 0.9 g/cm$^3$, and satisfies the relationships (1) and (2):

$$Y1 \leqq 61X-34 \quad (1)$$

$$Y2 \geqq -107X+123 \quad (2)$$

wherein X represents an apparent density of 0.7 to 0.9 g/cm$^3$ of the paper sheet substrate, Y1 represents an air permeability of the paper sheet substrate determined in accordance with JIS P 8117 using Type B testing device, and Y2 represents a Clark stiffness of the paper sheet substrate determined in accordance with JIS P 8143, in the cross direction of the coated paper sheet.

* * * * *